United States Patent [19]

DiMeo et al.

[11] 4,010,473

[45] Mar. 1, 1977

[54] ANTENNA CONSTRUCTION

[75] Inventors: Franklin Roosevelt DiMeo, Woodbury; William John Bachman, Mount Laurel, both of N.J.

[73] Assignee: RCA Corporation, New York, N.Y.

[22] Filed: Oct. 14, 1975

[21] Appl. No.: 622,261

[52] U.S. Cl. ..... 343/792.5; 343/811; 343/815

[51] Int. Cl.[2] ..... H01Q 11/10

[58] Field of Search ..... 343/792.5, 814, 811, 343/815

[56] References Cited

UNITED STATES PATENTS 3,599,217 8/1971 Grant ..... 343/792.5

*Primary Examiner*—Craig E. Church

*Attorney, Agent, or Firm*—Edward J. Norton; Samuel Cohen; William Squire

[57] ABSTRACT

A support member mounted on an antenna boom includes a pair of upstanding spaced stanchions for supporting a signal feedthrough wire therebetween. An antenna element is pivotally mounted to the support member and has a bifurcated end which conductively connects with the feedthrough wire when the element is rotated from a folded closed position to an extended open position.

17 Claims, 6 Drawing Figures

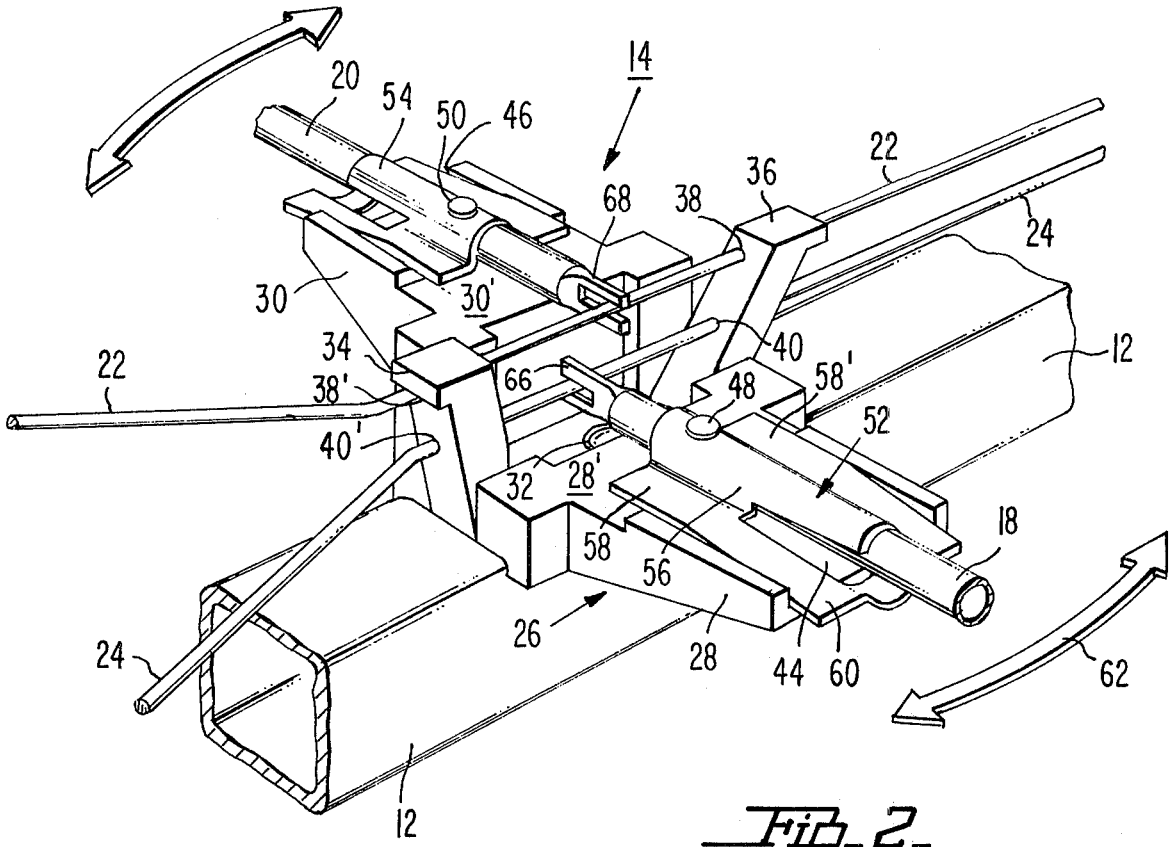
Fig. 2.
Fig. 3.
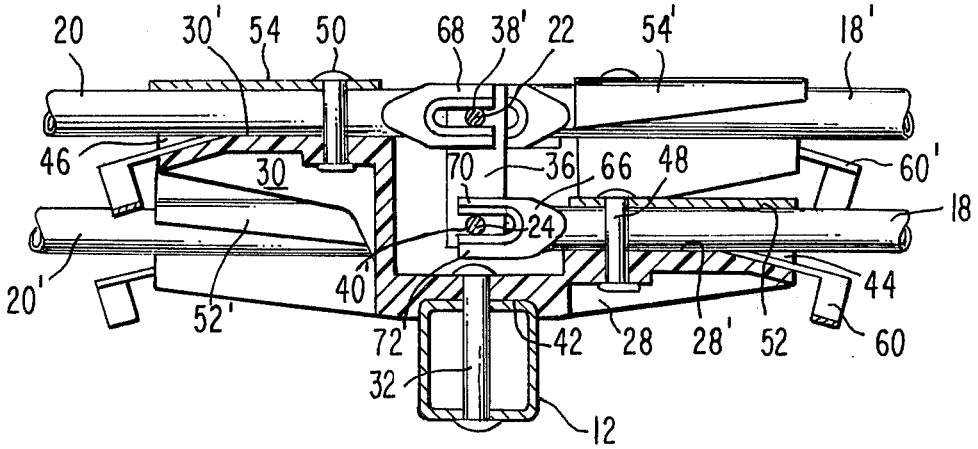

ANTENNA CONSTRUCTION

BACKGROUND OF THE INVENTION

The present invention relates to an antenna construction which is particularly suitable for use in an antenna of the type adapted to receive television broadcast signals.

DESCRIPTION OF THE PRIOR ART

A typical television antenna includes an extended elongated boom member on which is mounted a plurality of signal receiving elements or dipoles. These elements are elongated rods which extend outwardly from the boom in spaced relationship. Such a construction is awkward to package, handle and ship in the normal modes of commerce. To facilitate handling and packaging prior to the erection of the antenna by the user, the antenna is configured with the elements pivotally mounted to the boom so that the elements can be moved from folded, closed position next to the boom to an extended, open position. However, a problem arises with this construction. The elements must be insulated electrically from the boom assembly, but the elements themselves must be interconnected electrically in order to couple the received signal energy on each of the plurality of elements to a down-lead feeding the user's television receiver, for example.

Many different constructions have been devised for interconnecting a feedthrough electrical wire to each of such antenna elements. One typical construction attaches the feedthrough wire to a rivet which pivotally secures the element to the boom. However, this construction requires a certain amount of looseness to permit the rotation of the element and, thus can present poor ohmic contact to the feedthrough wire. Other constructions utilize straps separately attached to the element independent of the pivoting rivet member. This construction results in additional cost. Still another construction disposes a feedthrough wire between the pivotable element and a thermoplastic support member secured to the antenna boom. When the element is pivoted, it wipes against and squeezes the wire between the support member and the element. This construction is not completely satisfactory in that hysterisis, creep, thermal expansion and other characteristics present in the thermoplastic member result in degraded electrical contact between the wire and the element.

SUMMARY OF THE INVENTION

An antenna constructed in accordance with the present invention includes a boom and a signal element pivotally mounted on and electrically insulated from the boom. First and second insulative wire securing means are mounted in spaced relationship on the boom for suspending therebetween a signal wire. The element is mounted so that a contacting portion at an end thereof wipes against and electrically engages the suspended wire when the element is pivoted from a first folded position to a second extended, signal processing position.

IN THE DRAWINGS

FIG. 2 is a perspective view of a portion of the construction of FIG. 1 taken in the direction of arrow 2.

FIG. 3 is a partial sectional elevational view taken along lines 3—3 of FIG. 1.

DETAILED DESCRIPTION

Figure 1:
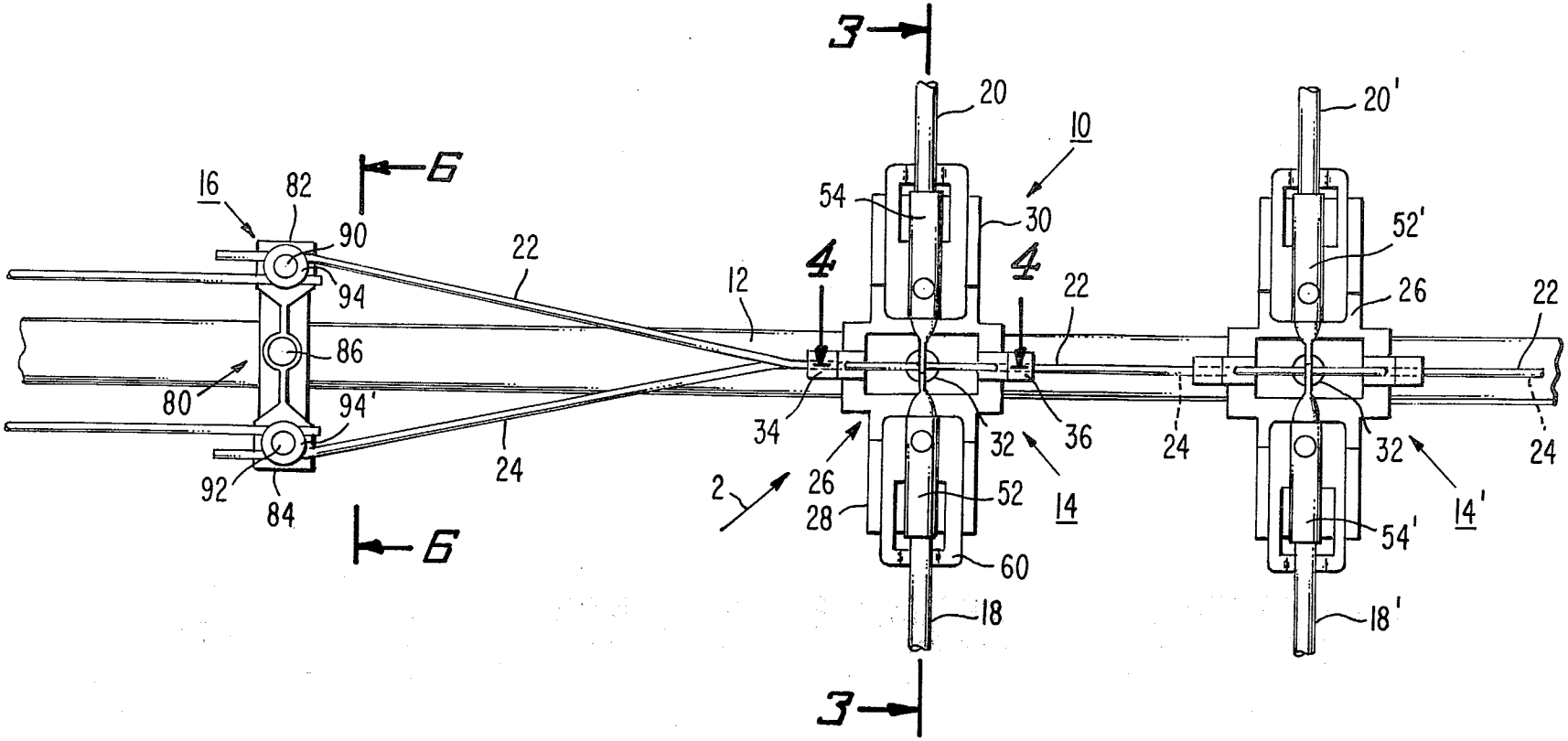
FIG. 1 is a plan view of a portion of an antenna constructed and operated in accordance with an embodiment of the present invention.
Figure 4:
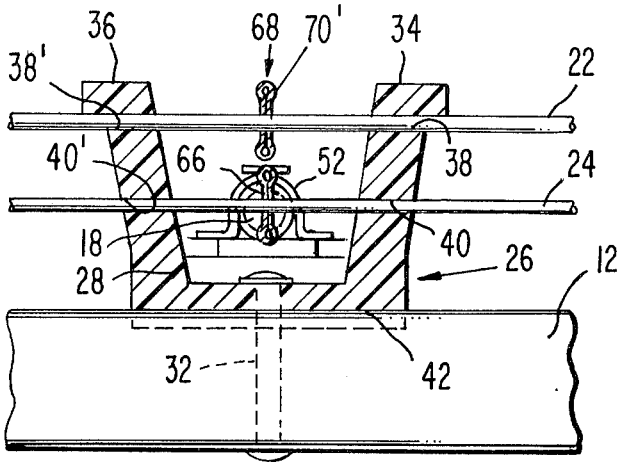
FIG. 4 is a partial sectional elevational view of the antenna construction of FIG. 1 taken along lines 4—4.

In FIG. 1, an antenna 10 constructed and operated in accordance with a preferred embodiment of the present invention includes a boom 12 and a plurality of dipole or signal receiving element mounting assemblies 14 and 14'. While two assemblies 14 and 14' are shown, in practice a much larger number of such assemblies are used. Also mounted on boom 12 is a feedthrough wire termination and support assembly 16. Element mounting assembly 14 is described in further detail with respect to FIGS. 2, 3 and 4, which description is typical of the description of the remaining element mounting assemblies such as the asembly 14'.

Boom 12 is a straight, elongated tubular member on which the assemblies 14 and 14' are mounted in axial spaced relationship. The antenna 10 preferably is constructed to receive signals in the broadcast television and frequency modulation (FM)bands. The boom 12 can be secured by suitable means (not shown) to an antenna support mast (not shown).

Mounted on and supported by the assembly 14 are a pair of elements 18 and 20 which are shown as extending outwardly from the boom 12. Mounted on assembly 14' are a pair of extending elements 20' and 18'. The spacing and lengths of the elements 20 and 18 on assembly 14 with respect to elements 20' and 18' on assembly 14' are determined in a manner well known in the antenna construction art and in itself forms no part of the present invention. Elements 18, 20, 18' and 20' are suitable rods preferably rolled from sheet aluminum alloy 25 mils thick. Only a portion of the rods 20, 20', 18 and 18' are shown in FIG. 1 for simplicity of illustration.

Disposed on one side of the boom are a pair of feedthrough wires 22 and 24. Wires 22 and 24 are disposed on the same side of boom 12 one above the other with respect to boom 12 and extend in parallel spaced relationship through and between the various element mounting assemblies 14 and 14' along the boom longitudinal axis. Wires 22 and 24 are anchored mechanically and terminated electrically in the support assembly 16 at one end of the wires as is described in detail in connection with FIG. 6. The other ends of the wires 22 and 24 can be free standing. The wires 22, 24 are preferably 125 mils diameter aluminum rod and, thus, are relatively stiff and rigid.

As is well known in the antenna construction art, the dipole elements such as elements 18, 20 or 18' and 20' are staggered electrically and mechanically so that the respective elements of a pair of elements, e.g., 18, 20 or 18', 20' are alternately electrically conductively connected to the respective feedthrough wire 22 and 24 for polarization purposes. In the construction illustrated in FIG. 1, elements 20 and 18' are electrically connected to feedthrough wire 22, and elements 18 and 20' are electrically connected to feedthrough wire 24. In addition, elements 20 and 18' lie in the same plane as feedthrough wire 22, while elements 20' and 18 lie in a lower different plane with feedthrough wire 24. The plane of wire 24 and elements 18 and 20' lies between boom 12 and wire 22.

A typical mounting assembly 14 will now be described. Riveted or otherwise firmly secured to boom 12 is a single, integral, unitary thermoplastic molded element mounting support 26. Support 26 is unique in that the identical piece 26 may be used to mount both the elements 20 and 18 of assembly 14 as shown in FIG. 2 and and also the reversely oriented elements 20' and 18' of assembly 14' of FIG. 1. Element mounting support 26 includes a pair of element support wings 28 and 30. Wings 28 and 30 have element support surfaces 28' and 30', respectively, on which are mounted the elements 18 and 20, respectively. Surfaces 20' and 30' are preferably parallel but disposed in different spaced planes which are spaced from boom 12. This is best seen in FIG. 3. Wings 28 and 30 are suitably ribbed to provide enhanced rigidity. Wings 28 and 30 extend away from boom 12 in diametrically opposite directions. Axially spaced from each other and extending from the base of the support 26 are a pair of upstanding feedthrough wire support stanchions 34 and 36. Each of stanchions 34 and 36 has a pair of suitable feedthrough wire support apertures 38', 40' and 38, 40, respectively, through which the respective wires 22 and 24 are passed. Apertures 38, 40 and 38', 40' are preferably molded into the stanchions. The fit of wires 22 and 24 in the respective apertures is not critical.

The molding of the stanchions 34 and 36 and wings 28 and 30 of the support 26 is conventional within the present state of the thermoplastic molding art. Apertures 38 and 40 of stanchion 36 are preferably axially aligned with the corresponding respective apertures 38' and 40' of stanchion 34, with the respective apertures spaced the same relative distance from the boom 12. In the exemplary embodiment, apertures 38 and 40 are spaced about 875 mils from each other in a direction normal to the boom 12. Aperture 40 is spaced about 625 mils from the boom 12 in this direction. This spacing is determinative of the electrical characteristics of the antenna.

Formed in support 26 is a suitable channel 42 which snuggly fits about the upper portion of boom 12 as best seen in FIG. 3. Surfaces 28' and 30' of wings 28 and 30, respectively, are disposed so that the respective elements 18 and 20 mounted on these surfaces are axially aligned with respective feedthrough wires 24 and 22 suspended between stanchions 34 and 36. The spacing between wires 22 and 24 of a given diameter and between the wires and boom 12 establishes the impedance of the feedthrough wires. These spacings are selected to provide optimum antenna performance. As provided by an antenna construction in accordance with the present invention, maintaining substantially constant the spacing and orientation of the feedthrough wires along the boom provides the desired constant impedance. In prior art arrangements, where a crisscrossing of the feedthrough wires is used, the resulting variations in spacing and therefore in impedance can degrade the characteristics of the antenna response. The present invention provides a simpler construction while providing improved performance. That is, the longitudinal axes of the elements 18 and 20 are respectively aligned with the longitudinal axes of the wires 22 and 24. In communication with surface 28' of wing 28 is a detent recess 44 which ramps outwardly and downwardly away from surface 28' to the extended end of wing 28. A similarly downwardly ramping recess 46 is formed in wing 30. The elements 18 and 20 are pivotally secured to wings 28 and 30, respectively, by rivets 48 and 50. Suitable element retaining spring clips 52 and 54 are secured by the rivets 48 and 50 to the respective elements 18 and 20 at tubular portion 56 to provide an element detent locking action. Clips 52 and 54 lock the elements in the radially outwardly extending position via typical wing recess 44 and clip detent portion 60. Clips 52 and 54 are identical and are used on assemblies 14 and 14' and other similar assemblies on the antenna. Support 26 being made of a thermoplastic material electrically isolates each of the elements 18 and 20, the boom 12 and the feedthrough wires 22 and 24 from each other. The portion of the wires 20 and 22 suspended between the stanchions 34 and 36 are relatively stiff and rigid for purposes to be explained.

In accordance with the present invention, a unique configuration is provided for each of the elements 18, 20, 18' and 20' (FIG. 1) for connecting the elements to the feedthrough wires 22 and 24. As seen in FIG. 3, this construction includes providing a yoke-shaped bifurcated end 66 and 68, respectively, for each of elements 18 and 20. End 66 of element 18 is typical of the ends of each of the elements on the antenna. Therefore, a description of end 66 only will be given herein. The axial depth of the bifuraction along the longitudinal axis of the element is made sufficiently great so that the two lines 70 and 72 forming the bifurcation are slightly resilient, for example, 10 mils, in the direction away from the wire 24 when the wire 24 is disposed therebetween. This resiliency permits an interference fit between wire 24 and tines 70 and 72. For purposes of illustration, the end 66 has a bifurcation axial depth of about 620 mils, nominally and a separation between the free ends of the tines of 94 mils. This results in an interference fit between the bifurcated end 66 of the feedthrough wire 24 of about 30 mils. The bifurcated ends may deform about 20 mils, leaving the 10 mils resiliency factor noted above. This resiliency provides enhanced electrical connection between the bifurcated end and the feedthrough wire by permitting repeated connections to be made without significantly wearing away the wire or the element or otherwise detrimentally affecting the electrical connection therebetween. Under conditions where vibration might tend to impart relative movement between the end 66 and the wire 24, it is possible without the resilience provided herein for the connection to wear to the point where electrical continuity is lost. It will be appreciated that a rigid connection without resiliency may be suitable in certain applications but that it is preferable that the resilience be provided. In any case, what is desired is a tight mechanical connection wherein repetitious openings and closings of the connection or vibrations of the elements will not cause excessive wearing of the connection to the point where electrical continuity is materially degraded or even broken.

Figure 5:
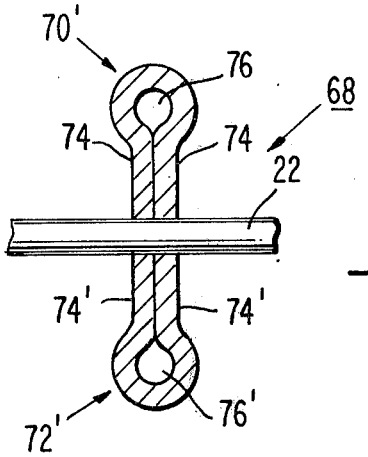
FIG. 5 is an enlarged view of that portion of FIG. 4 illustrating the connection of the bifurcated tines of the antenna element with a feedthrough wire.

The bifurcated end 66 can be formed by crushing the tubular shape at the end 66 of element 18 into a flat configuration. As shown in FIG. 5, this crushing can be done in a stamping operation in which the two tines 70', 72' are shaped to include crushed edges 74 and 74'. Each tine includes a tubular portion 76 and 76' at the outer end of the edges 74 and 74', providing enhanced structural rigidity to each of the tines. Crushed edges 74 and 74', respectively, provide a rigid wire contacting surface, while the tubular portions 76 and 76' provide a relatively strong structure when the tines are engaged with the feedthrough wire.

By employing a support 26, as described, in each of the assemblies such as assemblies 14 and 14' of FIG. 1, the connection of the elements 18', 20 and 18, 20' to the respective wires 22, 24 can be made with the proper polarization by simply reversing the orientation of every other support 26 on the boom 12. As best seen in FIG. 3, the wings 28 and 30 of assemblies 14 and 14' extend on different levels in diametrically opposite directions. This facilitates the connection of element 18' to wire 22, where the next adjacent element 18 extending in the same direction is connected to wire 24, and the connection of element 20' to wire 24 where the next adjacent element 20 extending in the same direction is connected to wire 22. The elements of additional assemblies (not shown) on the boom 12 would be connected in a similar manner.

Figure 6:
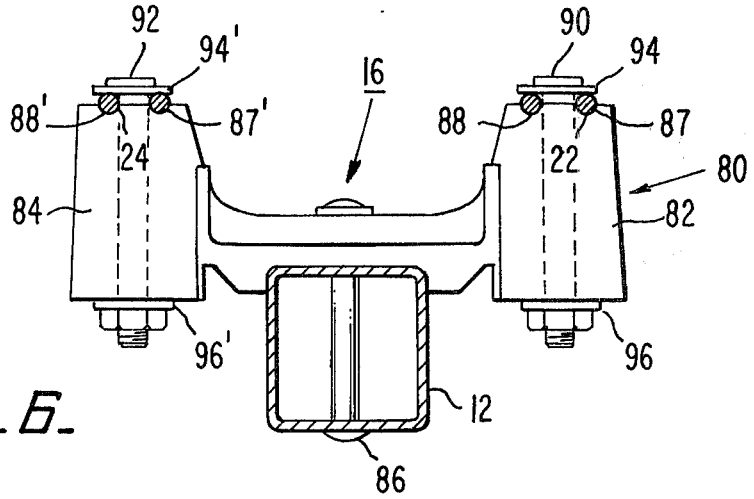
FIG. 6 is a sectional elevation view taken along lines 6—6 of FIG. 1 illustrating the termination of the feedthrough wires of FIG. 1.

The ends of the feedthrough wires 22 and 24 are terminated by a suitable support assembly 16 which anchors one end of the feedthrough wires and provides electrical terminal connections for a suitable cable to a transmission line. The termination of the feedthrough wires 22 and 24 is best seen in FIG. 6 illustrating the feedthrough wire support assembly 16. Assembly 16 is a molded thermoplastic single, integral unit 80 comprising a pair of wings 82 and 84. The unit 80 is riveted to the boom 12 by rivet 86. Formed at the upper surface of the upstanding portions of wings 82 and 84 are a pair of feedthrough wire receiving grooves 87 and 88 in wing 82 and grooves 87' and 88' in wing 84, respectively. A metal bolt, rivet or other suitable mechanically and electrically connecting fastener 90 and 92, respectively extends through each of the wings 82 and 84. The heads of fasteners 90 and 92 are mounted with suitable metal washers 94 and 94' which clamp the feedthrough wires 22 and 24, respectively, in the grooves.

In operation to close the element 18 in a folded position for convenience of packaging and handling, the antenna detent spring-loaded portion 60 is moved in the upward vertical direction (FIGS. 2 and 3) until portion 60 clears surface 28' of wing 28. At that time, the element 18 may be rotated in the direction 62 about rivet 48 wherein the detent portion 60 rests on the edges of surfaces 28' adjacent recess 44. The bifurcated end 66 will have been rotated clear and free of the feedthrough wire 24. To facilitate the free movement of the element 18, the surface 28' of the wing 28 can be stepped or otherwise cut away to permit the end 66 to move freely.

To place the element 18 in use, the element need only be rotated until the detent portion 60 engages recess 44 and the bifurcated end 60 engages the feedthrough wire 24. At this time the element is secured and is extended in its normal operational configuration. The relatively stiff wire 24 suspended between stanchions 34 and 36 resists the bending forces produced by element 18 when rotated into engagement with that wire. Also, the wire is sufficiently rigid to provide good electrical contact with end 66 without substantial deleterious cold working of the wire. The spacing of the stanchions 34 and 36, while not critical, is determined to provide lateral support to the wires when the elements are rotated into and out of engagement therewith between the stanchions. By way of example, the stanchions as used in one application of the invention were spaced about 2½ inches apart with wires 22 and 24, 125 mils in diameter.

The wires 22 and 24 being disposed on the same side of boom 12, one above the other, and being straight and parallel along the length of the boom, provide a simple and economical antenna construction not heretofore possible. A simple rotation of each of the dipole elements provides a good electrical connection with few parts.

What is claimed is:

1. An antenna construction comprising:
a support member,
a signal element including a wire contacting end portion,
a signal wire,
first and second wire securing means mounted in spaced relationship on and along the length of said member to suspend said wire therebetween while insulating said wire from said member, and
means for pivotally mounting said element on while insulating said element from said member to permit said contacting portion to wipe against and engage said suspended wire between said first and second securing means when said element is pivoted from a first non-contacting position to a second wire contacting position.

2. An antenna construction comprising:
a support member,
a signal element including a bifurcated wire contacting end portion including a pair of tines for gripping a wire therebetween,
a signal wire,
first and second wire securing means mounted in spaced relationship on and along the length of said member to suspend said wire therebetween while insulating said wire from said member, and
means for pivotally mounting said element on while insulating said element from said member to permit said tines of said contacting portion to wipe against and engage said suspended wire when said element is pivoted from a first non-contacting position to a second wire contacting position.

3. The construction of claim 2 wherein said tines are adapted to resiliently grip said wire.

4. The construction of claim 1 and including an insulating member mounted directly on said support member, said wire securing means and said element mounting means being mounted on said insulating member.

5. The construction of claim 4 wherein said insulating member and said wire securing means are formed in a single integral thermoplastic body with said first and second wire securing means extending outwardly from said support member in a given direction.

6. The construction of claim 1 further including a second signal element including a wire contacting end portion,
a second signal wire suspended by and between said wire securing means so as to be electrically isolated from said first wire and said member, and
means for pivotally mounting said second element on while insulating said second element from said member to permit said contacting portion thereof to wipe against and engage said second wire when said second element is pivoted from a non-contacting position to a wire contacting position.

7. The construction of claim 6 wherein said contacting portions are each bifurcated to receive one of said wires when engaged therewith.

8. An antenna construction comprising:
a boom,
a conductive rod having a bifurcated end,
a conductive wire,
a support member secured to said boom including a pair of upstanding spaced wire suspending members for supporting said wire therebetween and further including means by which said rod is pivotally mounted so that said bifurcated end conductively grips said wire between the tines of said end when the other end of said rod is moved away from said boom.

9. The construction of claim 8 wherein said wire suspending members each have a wire receiving aperture for receiving said wire, said construction further including wire anchoring means mounted on said boom for anchoring said wire to said boom while providing an electrical output terminal for said construction.

10. The construction of claim 8 wherein said support member is a single, unitary, integral thermoplastic unit.

11. The construction of claim 8 wherein said bifurcated end is adapted to resiliently engage said wire.

12. The construction of claim 8 further including a plurality of rods and a plurality of identical support members for supporting said rods and said wire.

13. In combination:
a boom,
a plurality of antenna dipoles each comprising first and second elements, and
a plurality of identical integral unitary dipole mounting supports mounted on said boom, each support securing one of said dipoles to said boom, said supports each having a pair of element support bases disposed in different elevated spaced relationships from one side of said boom for supporting said elements of a dipole extending in diametrically opposite directions with respect to said boom, the elevated spaced relationship of the support bases of each of said supports being the reverse of the elevated spaced relationship of the support bases of the next adjacent supports.

14. The combination of claim 13 and including:
a pair of wires,
each of said supports including a pair of upstanding members for supporting said wires therebetween and spaced from said one side of said boom with one of said wires spaced a first distance from said boom and the other of said wires spaced a second different distance from said boom, said first distance being determined to align said one wire with the lower support base of each of said supports and said second distance being determined to align said second wire with the higher support base of each of said support thereby facilitating the connection of said elements supported by said bases to respective ones of said wires.

15. In a television antenna including a boom and a plurality of signal receiving elements mounted on the boom for electrical connection to a wire, at least one element comprising:
an elongated electrically conductive rod,
means for pivotally mounting said rod so that said rod rotates about an axis normal to the rod longitudinal axis,
an end portion of said rod including a pair of wire gripping jaws extending radially away from said normal axis, said jaws being spaced from each other in a direction substantially parallel to said normal axis a distance sufficient to grip said wire therebetween.

16. The element of claim 15 wherein said rod is formed of sheet metal, each said jaw comprising a tubular portion and a planar portion depending from said tubular portion, an edge of said planar portion of said respective jaws facing each other.

17. The element of claim 15 wherein said jaws are resilient.

* * * * *